US008673114B2

(12) United States Patent
Krul et al.

(10) Patent No.: US 8,673,114 B2
(45) Date of Patent: Mar. 18, 2014

(54) METHOD FOR PRODUCING A WATERMARK ELEMENT, WATERMARK ELEMENT, AND ALSO APPLICATIONS

(75) Inventors: Johannes Krul, Beuningen (NL); Hendrik Van de Kamp, Beekbergen (NL); Jan Marius Van Dokkum, Ugchelen (NL)

(73) Assignee: Arjowiggins Security B.V., Ugchelen (NL)

( * ) Notice: Subject to any disclaimer, the term of this patent is extended or adjusted under 35 U.S.C. 154(b) by 55 days.

(21) Appl. No.: 13/120,738

(22) PCT Filed: Sep. 25, 2009

(86) PCT No.: PCT/NL2009/000188

§ 371 (c)(1), (2), (4) Date: May 12, 2011

(87) PCT Pub. No.: WO2010/036104

PCT Pub. Date: Apr. 1, 2010

(65) Prior Publication Data

US 2011/0290435 A1 Dec. 1, 2011

(30) Foreign Application Priority Data

Sep. 26, 2008 (NL) ..... 2002021
Jan. 21, 2009 (NL) ..... 2002436

(51) Int. Cl.

| | |
|---|---|
| ***D21H 27/02*** | (2006.01) |
| ***D21F 1/44*** | (2006.01) |
| ***B28B 1/48*** | (2006.01) |
| ***B29C 33/42*** | (2006.01) |

(52) U.S. Cl.

USPC ..... 162/110; 162/109; 162/116; 162/289; 162/296; 162/309; 162/312; 162/361; 162/362; 162/903

(58) Field of Classification Search

USPC ..... 162/109, 110, 289, 296, 309, 312, 140, 162/116, 117, 314, 361, 362, 903; 283/72, 283/113; 428/292.1, 141, 156, 187, 916; 492/32

See application file for complete search history.

(56) References Cited

U.S. PATENT DOCUMENTS 6,991,846 B2 * 1/2006 Mallol et al. ..... 428/292.1
2010/0175843 A1 * 7/2010 Gregarek ..... 162/140

FOREIGN PATENT DOCUMENTS

DE 102006058513 * 6/2008

*Primary Examiner* — Dennis Cordray
(74) *Attorney, Agent, or Firm* — Ryan A. Schneider, Esq.; Troutman Sanders LLP

(57) ABSTRACT

According to one aspect, the invention relates to a method for producing a watermark element (10) for forming a shadow watermark image in a substrate by means of dewatering of a fibrous suspension, wherein the watermark element (10) comprises a body with a relief side (12) having a relief (14) and a dewatering side (16) positioned opposite the relief side, perforations (18) being provided at least in the relief (14), a perforation (18) comprising a channel (20) with a channel inlet (21) at the relief side (12) and a channel outlet (22) at the dewatering side (16), which method includes the steps of forming perforations in a body in a mechanical manner and introducing a relief in the intended relief side, the perforations (18) being formed in such a way that the dewatering capacity, expressed as the open surface area of the channel inlet(s) per unit of surface area of the relief, is dependent on the height (h) of the channel inlet (21) with respect to the dewatering side (16), it being the case that the higher the height, the lower the dewatering capacity.

12 Claims, 2 Drawing Sheets

METHOD FOR PRODUCING A WATERMARK ELEMENT, WATERMARK ELEMENT, AND ALSO APPLICATIONS

CROSS-REFERENCE TO RELATED APPLICATIONS

This application is a US National Stage of International Application No. PCT/NL2009/000188, filed 25 Sep. 2009, which claims the benefit of both NL 2002436, filed 21 Jan. 2009, and NL 2002021, filed 26 Sep. 2008.

FIELD OF THE INVENTION

Firstly the invention relates to a method for producing a watermark element, which watermark element is used for forming a detailed shadow watermark image in a substrate. The invention further relates to a watermark element, a dewatering screen provided with one or more watermark elements, and also a method for producing a substrate with a shadow watermark image using the watermark element, and to the substrate itself.

BACKGROUND OF THE INVENTION

Watermarks have been used for centuries to mark and to recognize documents having a specific content or value. Watermarks are formed during the production of paper inter alia by influencing in a targeted manner the dewatering of a fibrous suspension from which the paper is made. For this purpose, a dewatering screen was originally provided with small, water-impermeable elements, as a result of which during the forming of sheets the deposition of fibres on the dewatering screen at the position of these elements differs from the deposition of fibres at locations of the screen without elements of this type. The effect is a light feature which is clearly perceptible when looking through. Later technological developments have led to what is known as the shadow watermark, a watermark with the most nuances in terms of shades of grey.

Shadow watermarks of this type are usually formed during the sheet-forming process with the aid of a round sieve as the dewatering screen. Elevated and lowered parts are introduced in the dewatering screen, which is usually made up of a plurality of layers of gauzed material, at least in the outermost layer of the screen. A homogeneous fibrous suspension is then brought into contact with the surface of the screen and sheets are formed on this surface, as a consequence of dewatering. The ultimate inhomogeneities in the distribution of fibres over the sheet are the result of deliberately introduced non-uniformities in or on the screen. More fibrous material is deposited in lowered parts of the screen than on elevated parts of the screen; the degree of elevation and lowering results ultimately in a specific greyscale value when looking through. Even fewer fibres are deposited in areas where larger (the term "larger" being used in this case in relation to the length of the fibres) completely water-impermeable parts are present than in the elevated parts of the screen. When the paper is eventually dry, then the parts containing the most fibrous material will be darker when looking through than the average and the parts containing the fewest fibres will be lighter. The thinnest parts in the paper are produced at the site of the completely water-impermeable parts. Because a shadow watermark of this type comprises both elevated and lowered parts and all transitions therebetween, many shades of grey can be produced, as a result of which shadow watermarks are obtained. The watermarks, use being made of only lighter parts with respect to the planum (=average greyscale value), will by definition have a lower greyscale value tonality than a complete shadow watermark.

The making of a dewatering screen, such as a round sieve with watermark elements, demands much experience and expert knowledge and is, moreover, very labour-intensive and as a result expensive. In a round sieve for the production of banknotes, several hundred watermark regions are often present on or in the layers of the screen. All these regions must ultimately yield an identical end result in the banknotes which are produced, so that very stringent demands are placed on the dimensioning and reproducibility.

A traditionally constructed round sieve with shadow watermark regions often consists of at least two gauze layers made of metal wire, referred to hereinafter also as the wire screen, the bottom layer(s) serving as supports for the outermost layer. The entity as a whole is vulnerable to mechanical damage. Undesirable disturbance, such as damage, in the surface of the screen causes a correspondingly undesirable effect in the forming of sheets. Undesirable disturbance in the watermark regions of the screen is usually immediately problematic. Mechanical damage occurs, during the production of paper, especially in the elevated parts of the surface of the screen. In the long run, this renders each dewatering screen with a watermark region unusable; a new, very expensive screen or outermost screen layer (screen cover) will then have to be made.

It is evident that the (limited) lifetime of a dewatering screen is one of the factors influencing the total production costs of paper with a watermark. Efforts have therefore been made to minimize the mechanical loading of the surface of the screen by transferring the sheet, as soon as it has been formed, from the dewatering screen to a take-off screen or cloth via a reduced pressure transfer technology; in this case, there is, generally speaking, no longer any mechanical contact between the couch roll and the surface of the screen and, as a result, the surface of the screen is spared.

Recently, DE 102005042344 has proposed locally providing a screen cover with a plate-shaped, perforated material which is brought, together with the screen lining, into a common relief form. The perforations in the plate-shaped material have micro dimensions. The advantage of this modified screen lining is said to reside in the creating of shadow watermarks provided with very light parts, also called electrotypes.

DE 10064006 explains how those parts of a watermark region of a dewatering screen that ensure very light parts in a watermark image, the so called electrotypes, can be fitted as an additional element in a watermark region with the aid of a shape memory material.

DE 10 2006 058 513 and WO 2008 071325 describe a watermark region consisting of an injection-moulded plastics material element with a relief, which relief is provided with perforations with the aid of a laser. For this purpose, holes are formed in a profiled element from the side opposing the profile using the laser. In an embodiment, the perforations become narrower from the back (dewatering side) in the direction of the relief side. It is stated that the perforations ensure free flowing of the paper suspension and that the watermark element regions having a greater material thickness allow the formation of thin spots in the paper.

A drawback of this known method is the fact that the precision of the perforation, in particular the diameter at the relief side, is highly dependent on the material properties, such as the nature of the plastics material and the local material thickness, and as a result the precision is difficult to control. The action of the laser produces holes which narrow toward the profile side. As a result of the physical processes which are involved in the perforating of a plastics material using a $CO_2$ laser, the shape of a perforation is, in the longitudinal direction of the channel, more or less conical at the lasered side owing to the Gaussian energy distribution of the laser beam and the longer the channel is, the more this conical shape decreases. This provides narrowing perforations, the diameters of which at the profile side are in some way related to their height position in the profile. The decrease of the conical shape prevents the differences in greyscale value from being controlled more precisely in the final watermark image. The use of the laser for precisely controlling the diameter of the perforation as a function of the height of the profile thus leaves much to be desired.

BRIEF SUMMARY OF THE INVENTION

The object of the invention is in the first place to provide a method for producing highly detailed watermark elements that avoids the drawbacks of the known methods.

Still another object is to produce a dewatering screen, provided with one or more watermark elements, which is less vulnerable compared to the conventional wire screen.

Still another object is to provide a method for producing a dewatering screen with watermark elements and/or watermark regions which are produced from a single entity in situ with the dewatering screen.

Still another object is to provide security paper or a security document provided with a very highly detailed watermark.

A further object of the invention is to provide a method for producing a watermark element allowing a watermark having an electrotype effect to be made without adding a separate element specifically intended therefor.

For this purpose, the invention provides a method for producing a watermark element as defined in claim 1. The method for producing a watermark element includes mechanical working of a body, such as a thin plate, to provide a surface with perforations. The opposing surface is provided with a relief. The watermark element produced in accordance with the method of the invention for the forming of a shadow watermark image in a substrate by means of dewatering of a fibrous suspension has a relief side with a relief and a dewatering side positioned opposite the relief. One or more perforations connect—at least in the relief—the relief side to the dewatering side. A perforation comprises a channel with a channel inlet at the relief side and a channel outlet at the dewatering side. The relief side is that side of the element that is provided with a surface structure having differences in height (the relief) defining the watermark which is ultimately to be made. From the point of view of flowing, the relief side is that side against which the fibrous mass flows during the production of paper. The opposing side is referred to in this case as the dewatering side, because this side has the function of draining water which flows through the perforations of the watermark element. According to the method of the invention, the perforations are formed in a mechanical manner in such a way that the dewatering capacity, expressed as the open surface area of the channel inlet(s) per unit of surface area of the relief, is completely dependent on the height of the channel inlet(s) with respect to the dewatering side, it being the case that the higher the height is, the lower the dewatering capacity is. By forming conical perforations in a mechanical manner, it is possible to ensure automatically—without in any way adapting the tool to the individual perforations—that the diameter of the perforation at the relief side is a function of the height of the channel inlet of the perforation in question. The conicity of mechanically formed conical perforations does not decrease as it does in the case of a lasered conical perforation in plastics material, so that the dependency between the radius of the perforation and the vertical position in the relief is completely linear. In the watermark element produced in accordance with the method of the invention, the dewatering capacity is a direct function of the height of the relief, viewed from the dewatering side. The dewatering capacity determines the degree of deposition of the fibres: the lower the dewatering capacity, the fewer fibres are left behind and the lighter the resulting spot is in the final substrate when looking through.

The method for providing a watermark element according to the invention allows the dimensions of the perforations at the relief side, and as a result the various dewatering capacities within the relief, to be influenced differently, in a targeted manner and with very high precision over small surface areas, providing highly detailed (high-resolution) watermarks.

In a watermark element produced in accordance with the method of the invention, the local dewatering capacity is directly related to the height of the perforation(s) in question in the relief at that position. Owing to the relief, a channel inlet will often not be present in a plane parallel to the dewatering side. The height is then, for example, defined as the average height of the channel inlet.

Owing to the high resolution, a watermark, produced with the aid of a watermark element produced in accordance with the method of the invention, can have smaller dimensions than a traditionally formed watermark at the same level of detail. After all, if the level of detail is higher and clearer, a watermark image, and thus the watermark itself, can be reduced in size as a whole while still remaining very clear. A practical advantage of this is that a smaller space has to be reserved for the watermark, for example when designing a banknote. This also offers the possibility of making room for at least two small, highly detailed watermarks in a document (for example a banknote) without affecting the space available for other security features or information.

In the context of the present application, the following definitions are used:

The term "(dewatering) screen" refers in this description to any (dewatering) surface in the form of dams defining openings, such as a plate with perforations or a woven porous surface.

The term "shadow watermark" describes a watermark which produces a watermark image having more than two different shades (of grey).

The term "watermark image" is used for the optical image of the watermark in the end product (usually when looking through), such as in a security document or security paper.

The term "watermark region" denotes that part of a dewatering screen that has, as a result of deliberately and specifically introduced properties, a shape and dewatering such that it is responsible, during the forming of sheets, for the forming of a watermark in the end product.

The term "paper" denotes a flat-shaped material (sheet, roll) made of fibrous material based on natural and/or synthetic fibres. Vegetable fibres, which are used in the production of paper, consist largely of cellulose. Wood is the most important source thereof. For higher-quality paper, use is also made of other fibres, such as fibres made of flax, abaca and cotton.

The term "security paper" refers to paper having at least one security feature allowing the authenticity of the paper in question to be established with the aid of human senses and/or using an aid, for example a measuring apparatus. The paper is for this purpose provided with a feature of this type during the manufacture of the paper. A watermark is an example of a security feature of this type, as are integrated security wires, chips, etc. In the context of this description, the term "security paper" also includes securities.

The term "a security document" denotes a sheet-shaped document comprising information, such as for example alphanumeric data, patterns and/or symbols, wherein it is important that the authenticity of the document as a whole may be established based on at least one security feature which is present. The feature in question may be present both in the paper and on the paper, such as for example a specific manner of imprinting or a specific optically active security feature. As a consequence, a security document may be made both of security paper (security feature in paper, introduced during the production of the paper) and of normal paper on which, after the paper has been produced, security features are introduced, for example as a result of the use of particular printing technologies or by finally introducing a security feature to be monitored, such as for example a hologram, a chip, etc.

A depression in a surface or side denotes a local cavity which is accessible just from one side and not from the opposing side.

For mechanically removing material from the body in order to form the perforations, use may be made of, in particular, machining processes such as milling and drilling. These technologies may be applied to a very large number of materials, such as metal, metal alloy, plastics materials and even ceramic materials. Metals and metal alloys are preferable with a view to lifetime and compatibility with conventional wire mesh materials. Thus, the invention has a broader scope in terms of materials than the injection-mouldable plastics materials as in DE 10 2006 058 513.

The method according to the invention for producing a watermark element includes at least the steps of mechanically forming perforations, according to a preferred embodiment conical perforations, in the intended dewatering side of a carrier body, advantageously a metal plate, and introducing the relief in the intended relief side by removing material from the carrier body. These steps can be carried out in any desired order. Advantageously, depressions are first formed in the future dewatering side of the watermark element, after which the relief is provided in the opposing side.

According to an embodiment of a watermark element produced in accordance with the method of the invention, the flow-through surface area (calculated in a plane parallel to the dewatering side) of a channel increases from the channel inlet in the direction of the associated channel outlet. More particularly, the perforations advantageously have a channel which tapers continuously from the channel outlet in the direction of the channel inlet, such as conical channels, the channel outlets preferably having an equally flow-through surface area at the dewatering side. Channels tapering from the channel outlet or tapering depressions can easily be introduced in an object, for example by milling from the dewatering side of the element, so that when introducing a relief, for example by milling, channel inlets having a cross section which is completely dependent on the height of the relief are "automatically" obtained in a plane parallel to the dewatering side. This also applies when there are introduced first the relief and afterwards conical channels from the dewatering side, all introduced, for example, using a milling cutter up to a standard stop thereof. The relief side can also be introduced via other methods such as etching and spark erosion.

In the case of conical perforations, a channel inlet will automatically become larger as more and more material is removed at the relief side and the cross section of the channel, in a plane parallel to the dewatering side, will thus be strictly dependent on the local height of the relief on site. Tiny channel inlets may thus be present in the highest parts of the watermark element. It is not necessary for each conical depression formed to open out into the relief side. With the aforementioned tiny channel inlets and conical depressions, the latter thus being water-impermeable, it is possible to obtain watermark images with very detailed electrotypes by precisely controlling the dewatering process. Automation and multiple working to make a plurality of watermark regions/elements simultaneously are within the possibilities of the method according to the invention. In addition to the higher level of detail, the lifetime of a wire mesh screen provided with separate watermark elements according to (produced in accordance with) the invention as the dewatering screen is longer than that of a traditional wire mesh screen in which the watermark regions are made as a result of the deformation of the wire gauze.

The method for producing a watermark element according to the invention also allows an electrotype region to form an intrinsic/integral part of the watermark element while an electrotype region of this type in a watermark region formed traditionally by screen fabric is still a separate element which is added to the watermark region in the outer layer of the screen.

The material of the watermark element is advantageously plate-shaped, for example having a thickness of from 0.5-10 mm, preferably with a flat dewatering side. The nature of the material from which the watermark element is made is not critical. Metals, such as copper and bronze, stainless steel, plastics materials or hybrid forms of materials are examples of suitable starting materials which can be mechanically machined. Ceramic materials may also be used. The wetting characteristics, for example hydrophobicity/hydrophilicity of the starting material, are advantageously taken into account, at least locally in the designing of the watermark element, in order to control the dewatering. The wetting characteristics may be modified if necessary. This is possible using various surface treatments such as for example a corona treatment or coating. A treatment of this type can be carried out before perforations and/or relief(s) are introduced, although a treatment of this type is preferably carried out afterwards, so that identical wetting characteristics are uniformly present both on the surface in question and/or in the associated channels.

Watermark elements may first be formed in accordance with the method of the invention and then be fitted in/on a surface of the screen. A solid, plate-shaped body may also be fitted in/on a (plate-shaped) screen, after which the machining of the body to form a watermark region in the screen is carried out in accordance with the method of the invention.

The body may also be a single-piece dewatering surface which is external to a watermark region to be formed, made of solid material and already comprising through-openings, such as a plate provided with perforations, in which the watermark element is formed in situ by machining in accordance with the invention. In an embodiment of this type, the watermark element and the surface of the screen are made in one piece; this benefits the lifetime. An embodiment of this type requires no fitting whatsoever of the water element in/on the surface of the screen. A method of this type also has the advantage of allowing a continuous transition from the watermark image to the environment. The latter aspect is comparable to the continuous transitions which are usually created in the traditional watermarks formed by a relief in a wire gauze, but now with watermark images containing many more details. If watermark regions have been mounted in wire mesh screens, there may always be observed in transmission a transition in the final paper substrate thereby produced between the watermark region resulting from the forming of sheets on the perforated body of the watermark region and the sheet formed on the surrounding screen fabric.

The cross section of the channels may be of any shape, such as round, square, ellipsoidal or polygonal. Conical channels having a circular cross section are preferable, as was previously described. Advantageously, the channels are arranged in a uniform pattern.

According to another embodiment of the method according to the invention, the perforations are formed as channels having a cross section which is a constant over the height (=longitudinal direction of the channel), the cross section in a plane parallel to the dewatering side being dependent on the height position of the channel inlet with respect to the dewatering side. In this embodiment, the vertical position of the channel inlet in the relief determines the cross section of the channel as a whole. In other words, perforations with a channel inlet at the same vertical position in the relief have the same constant cross section throughout the body of the watermark element. In practice, in the case of non-conical holes, the height of the relief will be divided into regions, each region being related to a specific dewatering capacity (cross section of channel inlet(s)). For example, the range of the height of the relief is divided into a limited number of vertical regions such as at most twenty regions, each with its own associated diameter of a cylindrical channel. Advantageously, at least two and at most five regions are distinguished. These cylindrical perforations may be formed, in contrast to conical perforations, both from the relief side and from the opposing side via the aforementioned technologies.

According to still another embodiment for producing a watermark element according to the invention, the perforations comprise the same channels having a cross section which is constant over the height/length of the channels in a plane parallel to the dewatering side, the perforation density (number of perforations/unit of surface area of the relief) being, in order to obtain the intended effect, dependent on the height position in the relief with respect to the dewatering side.

The application of conical channels has the advantage that the dewatering capacity proceeds continuously, as a function of the height of the relief, and not in a more step-by-step manner such as in the case of channels having a constant (for example circular) cross section.

A second aspect of the invention relates to a watermark element, preferably produced in accordance with the method according to the invention, for forming a shadow watermark image in a substrate by means of dewatering of a fibrous suspension, the watermark element comprising a plate-shaped body with a relief side having a relief and a dewatering side positioned opposite the relief side, perforations being provided at least in the relief, a perforation comprising a channel with a channel inlet at the relief side and a channel outlet at the dewatering side, the perforations being designed in such a way that the dewatering capacity, expressed as the open surface area of the channel inlet(s) per unit of surface area of the relief, is dependent on the height (h) of the channel inlet with respect to the dewatering side, it being the case that the higher the height, the lower the dewatering capacity. The aforementioned preferences for the method according to the invention are applicable in a corresponding manner to the watermark element according to the invention.

A further aspect of the invention relates to a dewatering screen for producing paper from a fibrous suspension, which screen comprises one or more layers of screen material, the outermost layer of which is provided with one or more watermark elements produced in accordance with the method of the invention. A dewatering screen may be any surface containing openings which are separated by dams (and delimited by the dam walls). These screen openings, such as meshes made of a woven screen material, are adapted to the dewatering function during the production of paper. A dewatering screen usually comprises a support screen having relatively large screen openings, on which one or more further screen layers having smaller screen openings are provided. Gauzed (woven) screen material, galvanically formed (electroformed) screen material, plate-shaped material with perforations and combinations thereof are examples of suitable materials for the dewatering screen. The dewatering screen according to the invention affords the aforementioned advantages.

A watermark element produced in accordance with the method of the invention may easily be fitted in a dewatering screen with the aid of known processes such as soldering, gluing or clamping in a screen, in particular when the starting materials of the dewatering screen and watermark elements are similar in terms of chemical nature and/or physical appearance.

It is possible for the dewatering part of a surface to have at the site of a watermark element a greater or lesser thickness than the remainder of the surface such as a plate-shaped material, wherein the differing thickness may be such that the surface of the watermark element coincides with that of the environment, protrudes thereabove or is, by contrast, positioned below the surrounding surface.

In addition to a watermark element according to (produced in accordance with) the invention, a dewatering screen may also comprise other watermark regions, of which the watermark element may or may not be part. Examples of other watermark regions include inter alia a relief structure (obtained by embossing) in a wire screen and a two-grade/tone pixel watermark region as, for example, is described in EP 1 122 360.

A watermark element according to the invention is advantageously present in a surface of the screen in such a way that the highest parts of the surface of the watermark element substantially coincide with the planum of the screen (if adjoining an embossed watermark region of the wire gauze: with the non-elevated parts of screen material in the immediate environment). Advantageously, the watermark element protrudes above the planum by less than 2 mm, preferably less than 1 mm. As a result of very minor elevations of this type in the dewatering screen, the watermark elements according to the invention are less vulnerable to mechanical damage during the production of paper. Furthermore, on account of the rigidity of the watermark element according to the invention, the mechanical load carrying capability of the watermark elements in or on the dewatering screen will, as a function of the selection of the starting materials, be greater than the watermark regions made of a conventional wire screen material. The watermark element according to the invention may also be positioned so as to be countersunk with respect to the planum of the screen.

In a dewatering screen consisting of a plate material and comprising at least one watermark element according to the invention, of the relief of the watermark element in question, if introduced in a flat screen surface by removing plate material from the surface of the screen, only the very highest parts of the relief will coincide with the surface of the screen while the remaining parts of the relief will remain therebelow. If the surface of the screen is elevated at the site of the watermark element, at least a part of the relief will also be elevated with respect to the environment and, on lowering of at least a part of the watermark region, the relief will also be lowered with respect to the immediate environment.

In a plate-shaped screen having watermark elements fitted therein (that is to say that the surface of the watermark elements did not already form an integral part of the surface of the screen), the position of the relief may again vary from lying wholly or partly above the surface of the screen, at most level with the surface and finally entirely below the surrounding surface, in all cases as a function of the position for fitting the element in/on the surface of the screen.

According to still another aspect, the invention relates to a method for producing a substrate with a shadow watermark, which method includes at least a step of sheet forming by dewatering of a fibrous suspension on a dewatering screen, the dewatering screen being provided with one or more watermark elements produced in accordance with the method of the invention.

The invention also relates to security paper provided with one or more watermarks, a watermark being at least partially constructed from a collection of discontinuities of fibrous material having more than 2 thicknesses of the discontinuities, the amounts of fibrous material in the discontinuities being proportional to the thickness thereof. The paper according to the invention is distinguished by a watermark which is at least partially constructed from separate depositions of fibres, comparable to pixels in printing applications. The amount of fibrous material deposited per unit of surface area ("pixel") is proportional to the thickness of the discontinuity in question in the watermark. As a result, the discontinuities have shades of grey which are discrete (with respect to the immediate environment) when looking through and take up more than 2 different values.

Finally, the invention also includes a document comprising security paper according to the invention. Examples of documents of this type include banknotes, passports, identity cards, travel documents, tickets, deeds, etc.

BRIEF DESCRIPTION OF THE DRAWINGS

The invention will be described hereinafter based on the appended drawings, in which.

It should be noted from the outset that the figures are not shown to scale; even components within a figure may not be compared to one another in terms of scale.

DETAILED DESCRIPTION OF PREFERRED EMBODIMENTS

Figure 1:
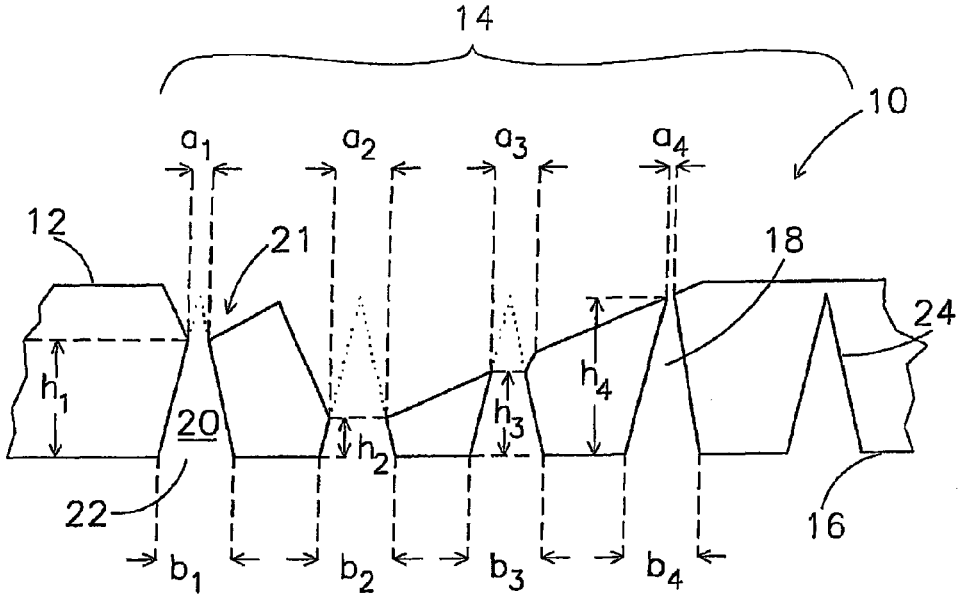
FIG. 1 is a cross section of an embodiment of a watermark element according to the invention.

FIG. 1 is a cross section of an arbitrary portion of an embodiment of a plate-shaped watermark element 10 according to the invention. The watermark element 10 has a relief side 12 provided with a relief 14, defined in the illustrated situation by lowered parts with respect to the surface of the relief side 12, and also an opposing dewatering side 16. Perforations 18 are provided in the body of the watermark element 10. A perforation 18 comprises a continuous channel 20 with a channel inlet 21 at the relief side 12 and a channel outlet 22 at the dewatering side 16 of the watermark element 10. The perforations 18 are conical, so that of each perforation 18 the channel inlet 20 has a smaller cross section (calculated in the plane parallel to the dewatering side 16) than the associated channel outlet 22. A dotted line denotes the original cone shape of the perforation 18, preceding the introduction of the relief 14. The channel outlets 22 have in this embodiment an equal cross section b. In other words, $b1=b2=b3=b4$ and the channel outlets 22 are positioned at the same distance from one another. The dewatering capacity, in this case the cross section a of the channel inlets 20, is dependent on the height h with respect to the dewatering side 16. In the illustrated situation, the height is $h2<h3<h1<h4$. The cross section a of the channel inlets 21 is inversely related thereto, i.e. $a2>a3>a1>a4$. A depression 24 at the dewatering side, which is not opened at the relief side as a result of the introduction of the relief 14, is also represented in this figure. In this way, it is possible to produce an electrotype effect in the shadow watermark without adding an external element.

Figure 2:
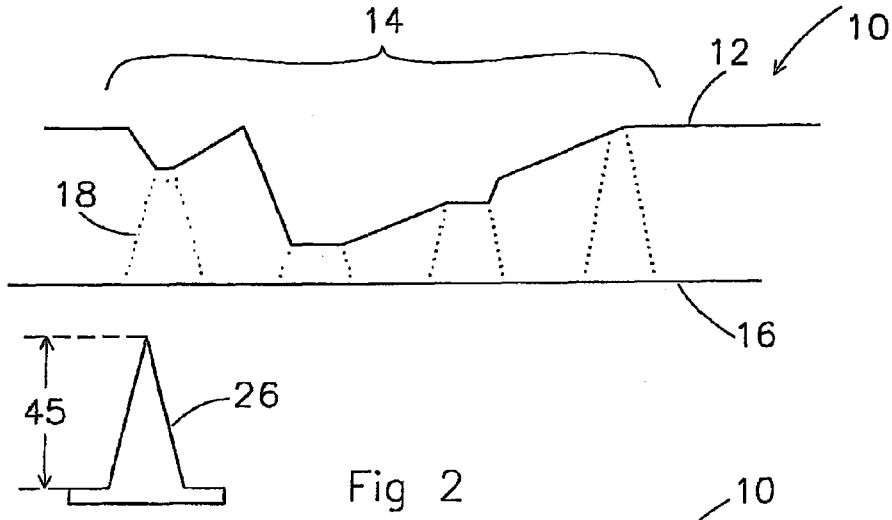
FIG. 2 illustrates schematically an intermediate phase of an embodiment of a method for producing a watermark element according to the invention.

The watermark element 10 according to FIG. 1 can be made in a number of ways. In one embodiment thereof, the relief 14 is first introduced into the relief side 12, for example with the aid of a machining or abrasive technology in a flat metal or polymer plate. The result of that working is sketched in FIG. 2. Subsequently, a conical perforation is formed to a predefined depth using a suitable tool, for example using a milling cutter 26 at the desired positions, so that the diameter of a channel inlet displays, viewed in a plane parallel to the dewatering side, linear proportionality to the height of a channel inlet with respect to the dewatering side. A frustoconical milling cutter may also be used. The perforation is illustrated in FIG. 2 by dotted lines. Because the height h5 of the milling cutter is greater than that of a number of parts at those positions, perforations 18 are thus formed, thus providing a watermark element represented in FIG. 1.

Figure 3:
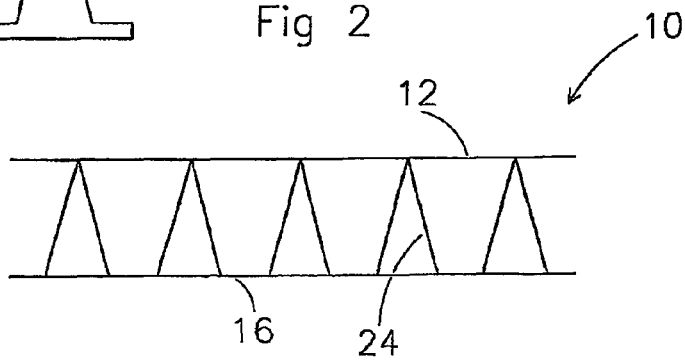
FIG. 3 illustrates schematically an intermediate phase of another embodiment of a method for producing a watermark element according to the invention.

FIG. 3 illustrates another embodiment of a method of producing a watermark element according to the invention. In this case, in a flat plate, a pattern of completely conical depressions 24 is first provided from the future dewatering side (see FIG. 2), after which the relief is introduced from the future remaining relief side by removing material. Again, this working provides perforations 18 having a cross section a of the channel inlet that is dependent on the height h with respect to the dewatering side. Of course, it is also possible to immediately form perforations instead of depressions, the size of the channel inlet being increased as a function of the relief height during the introduction of the relief.

Figure 4:
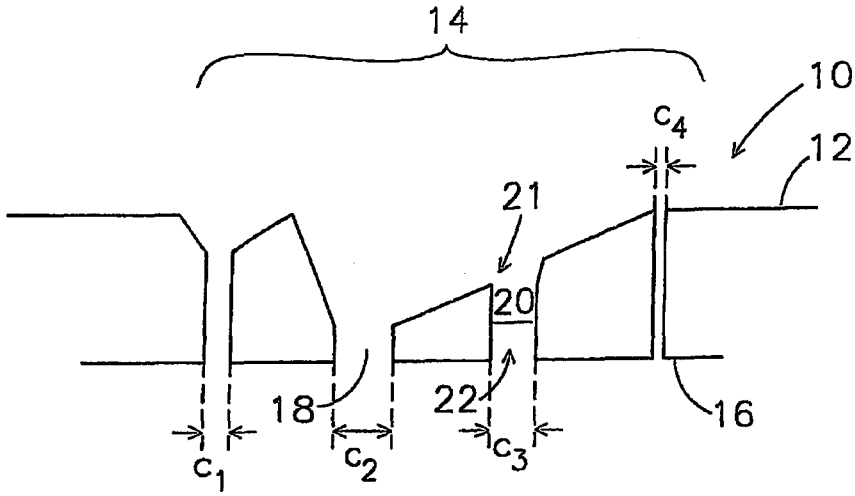
FIG. 4 is a cross section of a further embodiment of a watermark element according to the invention.

FIG. 4 is a cross section of another embodiment of a watermark element 10 according to the invention, the perforations 18 having, starting from the same relief as in FIG. 1, a channel having a cross section which is constant over the height h. That cross section, denoted here by c, is dependent on the height h of the channel inlet 21 with respect to the dewatering side 16. In other words, given that $h2<h3<h1<h4$ (see FIG. 1), the following applies to the diameter c (in the case of round holes): $c2>c3>c1>c4$.

Figure 5:
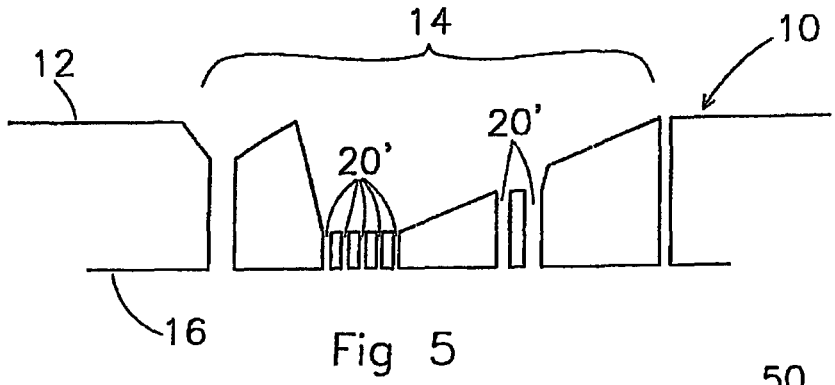
FIG. 5 is a cross section of still another embodiment of a watermark element according to the invention.

FIG. 5 shows still another embodiment of a watermark element 10 according to the invention. In this embodiment, it is still the case that the dewatering capacity is dependent on the height of the relief. However, in this case, compared to the embodiments according to FIGS. 1 and 4, the perforations having a high dewatering capacity are divided into a number of sub-channels 20'. However, the total dewatering capacity on site is not reduced.

Figure 6:
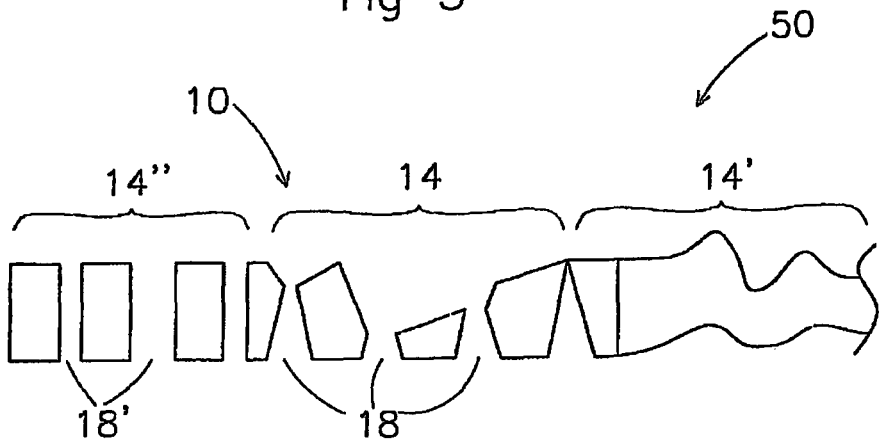
FIG. 6 is a cross section of an embodiment of a dewatering screen according to the invention.

FIG. 6 shows a dewatering screen 50 consisting, in this specific case, of gauzed material with an inserted watermark element 10 according to the invention. A relief 14' made of gauzed material is provided on the right-hand side adjoining the watermark element 10. Perforations 18' with different diameters but without a relief are provided adjoining to the left. These perforations 18' will provide a two-tone portion of a watermark, while the relief structure 14 with perforations 18 and the relief structure 14''' provide a shadow portion of the watermark, the electrotypes originating in particular from the watermark element 10 according to the invention. It goes without saying that at least the outermost surface of the dewatering screen may also be made of a perforated, plate-shaped material, wherein watermark regions according to the method of the invention and also watermark regions formed from wire gauze and/or two-tone watermark regions may then be present in/on this material.

The invention claimed is:

1. Method for producing a watermark element for forming a shadow watermark image in a substrate by means of dewatering of a fibrous suspension, wherein the watermark element comprises a body with a relief side having a relief and a dewatering side positioned opposite the relief side, perforations being provided at least in the relief, a perforation comprising a channel extending a channel height (h) from a channel inlet on an exterior surface of the relief side to a channel outlet on an exterior surface of the dewatering side, the channel inlet and outlet having an open surface area defined as the cross sectional area of the channel inlet and outlet, respectively, at the surfaces of the relief and dewatering sides, the method comprising:

forming perforations in the body in a mechanical manner by a mechanical machining process; and introducing the relief in the intended relief side;

wherein the dewatering capacity of a perforation is expressed as the open surface area of the channel inlet of the perforation per unit of surface area of the relief;

wherein the dewatering capacity of a portion of the relief is the total open surface area of the channel inlets in that portion of the relief per the total surface cross sectional area of that portion of the surface of the relief side, and is dependent on the channel height (h) of each perforation in that portion of the relief;

wherein the higher the channel height of the perforation, the lower the dewatering capacity of that perforation; and wherein the perforations comprise channels having a uniform cross section along the channel height (h), the size of the area of the uniform cross section for each perforation dependent on the channel height (h) of each perforation.

2. Dewatering screen for producing paper from a fibrous suspension, comprising one or more layers of screen material, the outer layer of which is provided with one or more watermark elements, produced in accordance with the method according to claim 1.

3. Method for producing a sheet-shaped substrate with a watermark comprising forming a sheet by dewatering of a fibrous suspension on a dewatering screen according to claim 2.

4. Method for producing a watermark element for forming a shadow watermark image in a substrate by means of dewatering of a fibrous suspension, wherein the watermark element comprises a body with a relief side having a relief and a dewatering side positioned opposite the relief side, perforations being provided at least in the relief, a perforation comprising a channel extending a channel height (h) from a channel inlet on an exterior surface of the relief side to a channel outlet on an exterior surface of the dewatering side, the channel inlet and outlet having an open surface area defined as the cross sectional area of the channel inlet and outlet, respectively, at the surfaces of the relief and dewatering sides, the method comprising:

forming perforations in the body in a mechanical manner by a mechanical machining process; and introducing the relief in the intended relief side;

wherein the dewatering capacity of a perforation is expressed as the open surface area of the channel inlet of the perforation per unit of surface area of the relief;

wherein the dewatering capacity of a portion of the relief is the total open surface area of the channel inlets in that portion of the relief per the total surface cross sectional area of that portion of the surface of the relief side, and is dependent on the channel height (h) of each perforation in that portion of the relief;

wherein the higher the channel height of the perforation, the lower the dewatering capacity of that perforation; and wherein the open surface area of a channel inlet is linearly dependent on the channel height (h).

5. Dewatering screen for producing paper from a fibrous suspension, comprising one or more layers of screen material, the outer layer of which is provided with one or more watermark elements, produced in accordance with the method according to claim 4.

6. Method for producing a sheet-shaped substrate with a watermark comprising forming a sheet by dewatering of a fibrous suspension on a dewatering screen according to claim 5.

7. Method for producing a watermark element for forming a shadow watermark image in a substrate by means of dewatering of a fibrous suspension, wherein the watermark element comprises a body with a relief side having a relief and a dewatering side positioned opposite the relief side, perforations being provided at least in the relief, a perforation comprising a channel extending a channel height (h) from a channel inlet on an exterior surface of the relief side to a channel outlet on an exterior surface of the dewatering side, the channel inlet and outlet having an open surface area defined as the cross sectional area of the channel inlet and outlet, respectively, at the surfaces of the relief and dewatering sides, the method comprising:

forming perforations in the body in a mechanical manner by a mechanical machining process; and introducing the relief in the intended relief side;

wherein the dewatering capacity of a perforation is expressed as the open surface area of the channel inlet of the perforation per unit of surface area of the relief;

wherein the dewatering capacity of a portion of the relief is the total open surface area of the channel inlets in that portion of the relief per the total surface cross sectional area of that portion of the surface of the relief side, and is dependent on the channel height (h) of each perforation in that portion of the relief;

wherein the higher the channel height of the perforation, the lower the dewatering capacity of that perforation; and wherein the perforations comprise channels having a uniform cross section along the channel height (h), and the number of perforations/unit surface area of the relief is dependent on the channel height (h) in the relief.

8. Dewatering screen for producing paper from a fibrous suspension, comprising one or more layers of screen material, the outer layer of which is provided with one or more watermark elements, produced in accordance with the method according to claim 7.

9. Method for producing a sheet-shaped substrate with a watermark comprising forming a sheet by dewatering of a fibrous suspension on a dewatering screen according to claim 8.

10. Method for producing a watermark element for forming a shadow watermark image in a substrate by means of dewatering of a fibrous suspension, wherein the watermark element comprises a body with a relief side having a relief and a dewatering side positioned opposite the relief side, perforations being provided at least in the relief, a perforation comprising a channel extending a channel height (h) from a channel inlet on an exterior surface of the relief side to a channel outlet on an exterior surface of the dewatering side, the channel inlet and outlet having an open surface area defined as the cross sectional area of the channel inlet and outlet, respectively, at the surfaces of the relief and dewatering sides, the method comprising:

forming perforations in the body in a mechanical manner by a mechanical machining process; and introducing the relief in the intended relief side;

wherein the dewatering capacity of a perforation is expressed as the open surface area of the channel inlet of the perforation per unit of surface area of the relief;

wherein the dewatering capacity of a portion of the relief is the total open surface area of the channel inlets in that portion of the relief per the total surface cross sectional area of that portion of the surface of the relief side, and is dependent on the channel height (h) of each perforation in that portion of the relief;

wherein the higher the channel height of the perforation, the lower the dewatering capacity of that perforation; and wherein the channel inlet is circular, and the radius of the channel inlet open surface area is linearly dependent on its vertical position in the relief.

11. Dewatering screen for producing paper from a fibrous suspension, comprising one or more layers of screen material, the outer layer of which is provided with one or more watermark elements, produced in accordance with the method according to claim 10.

12. Method for producing a sheet-shaped substrate with a watermark comprising forming a sheet by dewatering of a fibrous suspension on a dewatering screen according to claim 11.

* * * * *